US011414309B2

(12) United States Patent
Kieser et al.

(10) Patent No.: US 11,414,309 B2
(45) Date of Patent: Aug. 16, 2022

(54) SYSTEM FOR CONTROLLING THE OPERATION OF AN ELECTRIC WINCH

(71) Applicant: Caterpillar Inc., Deerfield, IL (US)

(72) Inventors: Andrew J. Kieser, Morton, IL (US); Timonthy J. Schlack, Washington, IL (US); Evan B. Stumpges, Peoria, IL (US); Derek S. Sorrells, Saint David, IL (US); Eric J. Verplaetse, Peoria, IL (US); Matthew O. Nafziger, Mackinaw, IL (US); Timothy L. Hand, Metamora, IL (US)

(73) Assignee: Caterpillar Inc., Peoria, IL (US)

( * ) Notice: Subject to any disclaimer, the term of this patent is extended or adjusted under 35 U.S.C. 154(b) by 530 days.

(21) Appl. No.: 16/217,372

(22) Filed: Dec. 12, 2018

(65) Prior Publication Data

US 2020/0189890 A1 Jun. 18, 2020

(51) Int. Cl.

| | |
|---|---|
| ***B66D 1/50*** | (2006.01) |
| ***B66D 1/12*** | (2006.01) |
| ***B66D 1/48*** | (2006.01) |
| ***E02F 9/20*** | (2006.01) |
| ***E02F 3/16*** | (2006.01) |

(52) U.S. Cl.

CPC ..... *B66D 1/505* (2013.01); *B66D 1/12* (2013.01); *B66D 1/485* (2013.01); *E02F 3/16* (2013.01); *E02F 9/2016* (2013.01); *E02F 9/2095* (2013.01); *B66D 2700/0141* (2013.01)

(58) Field of Classification Search

CPC ..... B66D 1/505; B66D 1/12; B66D 1/485; B66D 2700/0141; B66D 1/46; B66D 1/60; E02F 9/2016; E02F 9/2095; E02F 3/16

See application file for complete search history.

(56) References Cited

U.S. PATENT DOCUMENTS

| | | | | |
|---|---|---|---|---|
| 2,683,318 | A | 7/1954 | Tourneau | |
| 3,249,336 | A | 5/1966 | Brown et al. | |
| 3,828,683 | A * | 8/1974 | Lehrer | B66C 21/04 212/72 |
| 4,078,770 | A | 3/1978 | Yates et al. | |
| 4,854,547 | A * | 8/1989 | Oliphant | B66D 1/50 254/326 |
| 9,702,111 | B2 | 7/2017 | Sokoloski | |

(Continued)

*Primary Examiner* — Sang K Kim
*Assistant Examiner* — Nathaniel L Adams
(74) *Attorney, Agent, or Firm* — Leydig, Voit & Mayer, Ltd.

(57) ABSTRACT

A system for controlling operation of a winch assembly having an electric motor, a drum, and a cable. A controller is configured to access a winch load threshold, with the winch load threshold defining a hold zone and a reel zone, and one of the hold zone and the reel zone including loads greater than the winch load threshold and another of the hold zone and the reel zone including loads less than the winch load threshold. The controller is further configured to determine whether the drum is rotating, determine whether the winch assembly is operating within the hold zone or the reel zone, generate a hold current while the winch assembly is operating within the hold zone preventing rotation of the electric motor, and generate a reel current while the drum is operating within the reel zone permitting rotation of the electric motor.

20 Claims, 8 Drawing Sheets

(56) References Cited

U.S. PATENT DOCUMENTS

| | | | | |
|---|---|---|---|---|
| 2010/0096926 | A1* | 4/2010 | King | B60L 50/16 307/45 |
| 2012/0253610 | A1 | 10/2012 | Anders et al. | |
| 2014/0091268 | A1* | 4/2014 | Heravi | B66D 1/505 254/274 |
| 2017/0203940 | A1* | 7/2017 | Holmberg | B66D 1/505 |

* cited by examiner

SYSTEM FOR CONTROLLING THE OPERATION OF AN ELECTRIC WINCH

TECHNICAL FIELD

This disclosure relates generally to winches on movable machines and, more particularly, to a system and method for maintaining a desired winch load generated by an electric winch.

BACKGROUND

Machines such as dozers often include a winch. The winch may be used to perform a variety of tasks and operate in different modes. These modes permit the winch cable to be reeled in or reeled out in a controlled manner to permit an operator perform a desired task. Mechanical winch assemblies are often difficult or challenging to control. Hydraulic winch assemblies may require a substantial amount of cooling capability in order to prevent overheating.

In some operations, when operating a machine such as an excavator along a steep slope, one or more dozers may be interconnected by winch cables to the machine on the slope. It is typically desirable for the dozer closest to the machine operating on the steep slope to have an experienced operator due to the complexity of the winch operation and risks associated with supporting the machine on the steep slope. However, experienced winch operators may not be available.

U.S. Pat. No. 2,683,318 discloses a dozer having a generator operatively connected to an engine. Output from the generator is used to operate an electric winch. The electric winch includes a motor, a brake unit, a gear box, and a cable drum. A cable is wrapped around the cable drum.

The foregoing background discussion is intended solely to aid the reader. It is not intended to limit the innovations described herein, nor to limit or expand the prior art discussed. Thus, the foregoing discussion should not be taken to indicate that any particular element of a prior system is unsuitable for use with the innovations described herein, nor is it intended to indicate that any element is essential in implementing the innovations described herein. The implementations and application of the innovations described herein are defined by the appended claims.

SUMMARY

In a first aspect, a system for controlling an operation of a winch assembly includes a rotatable winch drum, a winch cable, an electric winch motor, a rotation sensor, and a controller. The winch cable is wrapped around the rotatable winch drum, the winch motor is operatively connected to the rotatable winch drum, and the rotation sensor is configured to generate rotational data indicative of rotation of the rotatable winch drum. The controller is configured to access a winch load threshold, with the winch load threshold defining a hold zone and a reel zone of the winch assembly, and one of the hold zone and the reel zone including loads on the winch cable greater than the winch load threshold and another of the hold zone and the reel zone including loads on the winch cable less than the winch load threshold. The controller is further configured to determine whether the rotatable winch drum is rotating based upon the rotational data, determine whether the winch assembly is operating within the hold zone or the reel zone, generate a hold current while the winch assembly is operating within the hold zone, with the hold current varying based upon the load on the winch cable and preventing rotation of the electric winch motor, and generate a reel current while the rotatable winch drum is operating within the reel zone, with the reel current being based upon the winch load threshold and operating to permit rotation of the electric winch motor.

In another aspect, a method of controlling an operation of a winch includes accessing a winch load threshold with the winch load threshold defining a hold zone and a reel zone of the winch assembly, and one of the hold zone and the reel zone including loads on a winch cable wrapped around a rotatable winch drum being greater than the winch load threshold and another of the hold zone and the reel zone including loads less than the winch load threshold. The method further includes determining whether the rotatable winch drum is rotating based upon rotational data from a rotation sensor, with the rotatable winch drum including a winch cable wrapped therearound, determining whether the winch assembly is operating within the hold zone or the reel zone, generating a hold current while the winch assembly is operating within the hold zone, with the hold current varying based upon the load on a winch cable and preventing rotation of an electric winch motor, and generating a reel current while the rotatable winch drum is operating within the reel zone, with the reel current being based upon the winch load threshold and operating to permit rotation of the electric winch motor.

In still another aspect, a machine includes, a prime mover, a ground-engaging drive mechanism, a winch assembly, and a controller. The ground-engaging drive mechanism is operatively coupled to the prime mover to propel the machine. The winch assembly includes rotatable winch drum with a winch cable wrapped around the rotatable winch drum, an electric winch motor operatively connected to the rotatable winch drum, and a rotation sensor configured to generate rotational data indicative of rotation of the rotatable winch drum. The controller is configured to access a winch load threshold, with the winch load threshold defining a hold zone and a reel zone of the winch assembly, and one of the hold zone and the reel zone including loads on the winch cable greater than the winch load threshold and another of the hold zone and the reel zone including loads on the winch cable less than the winch load threshold. The controller is further configured to determine whether the rotatable winch drum is rotating based upon the rotational data, determine whether the winch assembly is operating within the hold zone or the reel zone, generate a hold current while the winch assembly is operating within the hold zone, with the hold current varying based upon the load on the winch cable and preventing rotation of the electric winch motor, and generate a reel current while the rotatable winch drum is operating within the reel zone, with the reel current being based upon the winch load threshold and operating to permit rotation of the electric winch motor.

DETAILED DESCRIPTION

Figure 1:
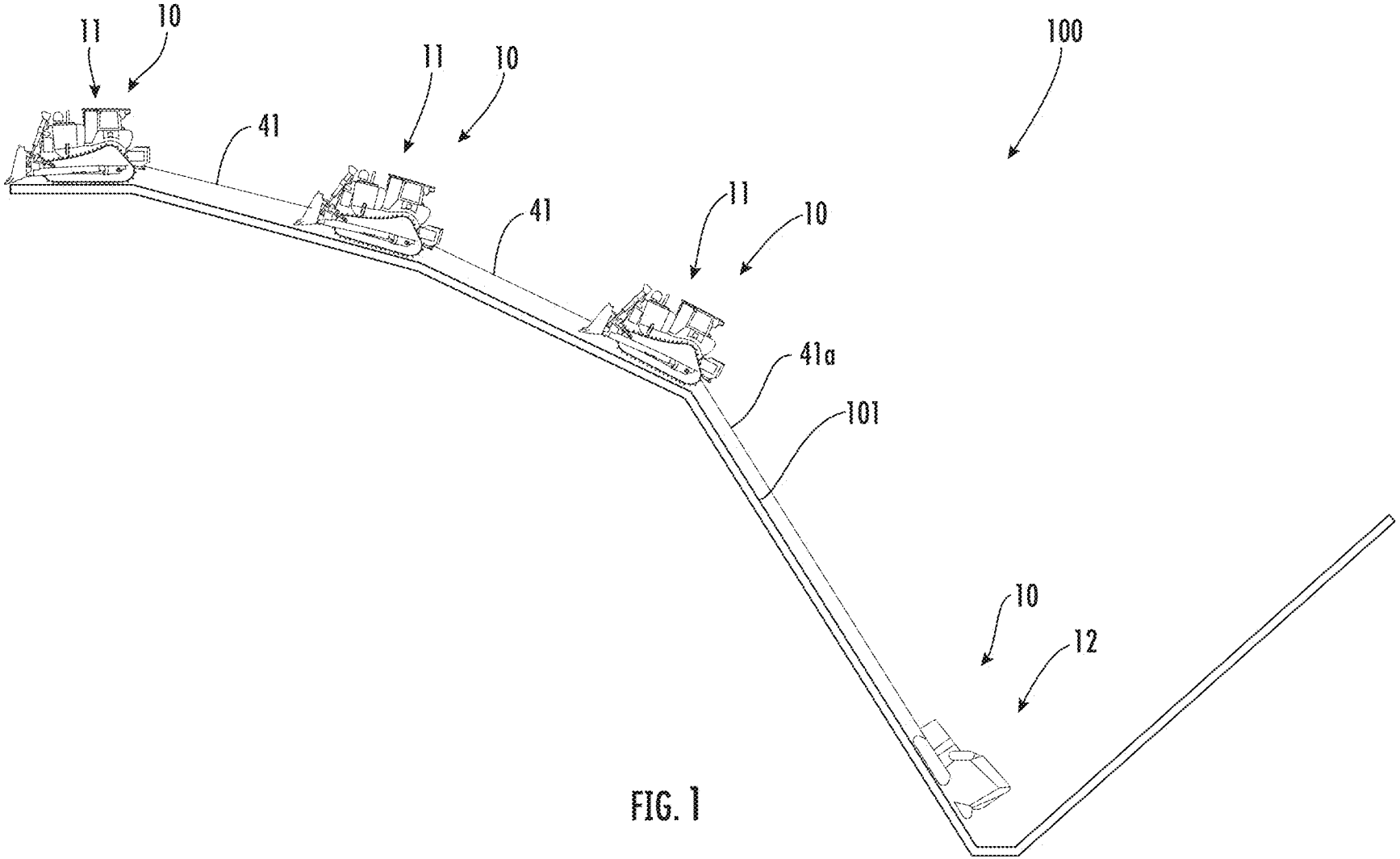
FIG. 1 depicts a diagrammatic illustration of a work site at which a machine incorporating the principles disclosed herein may be used.

FIG. 1 depicts a diagrammatic illustration of a work site 100 at which one or more machines 10 may operate to perform a desired task. Work site 100 may be a portion of a mining site, a landfill, a quarry, a construction site, or any other area. As depicted, work site 100 includes a group of dozers 11 that are interconnected by winch cables 41 and cooperatively support, through a further winch cable 41*a*, another machine such as an excavator 12 that is operating on a sloped work surface 101 configured as a steep slope. As described in more detail below, each dozer 11 includes a winch assembly 40 for controlling the winding and unwinding of the winch cable 41 operatively associated with that machine.

Figure 2:
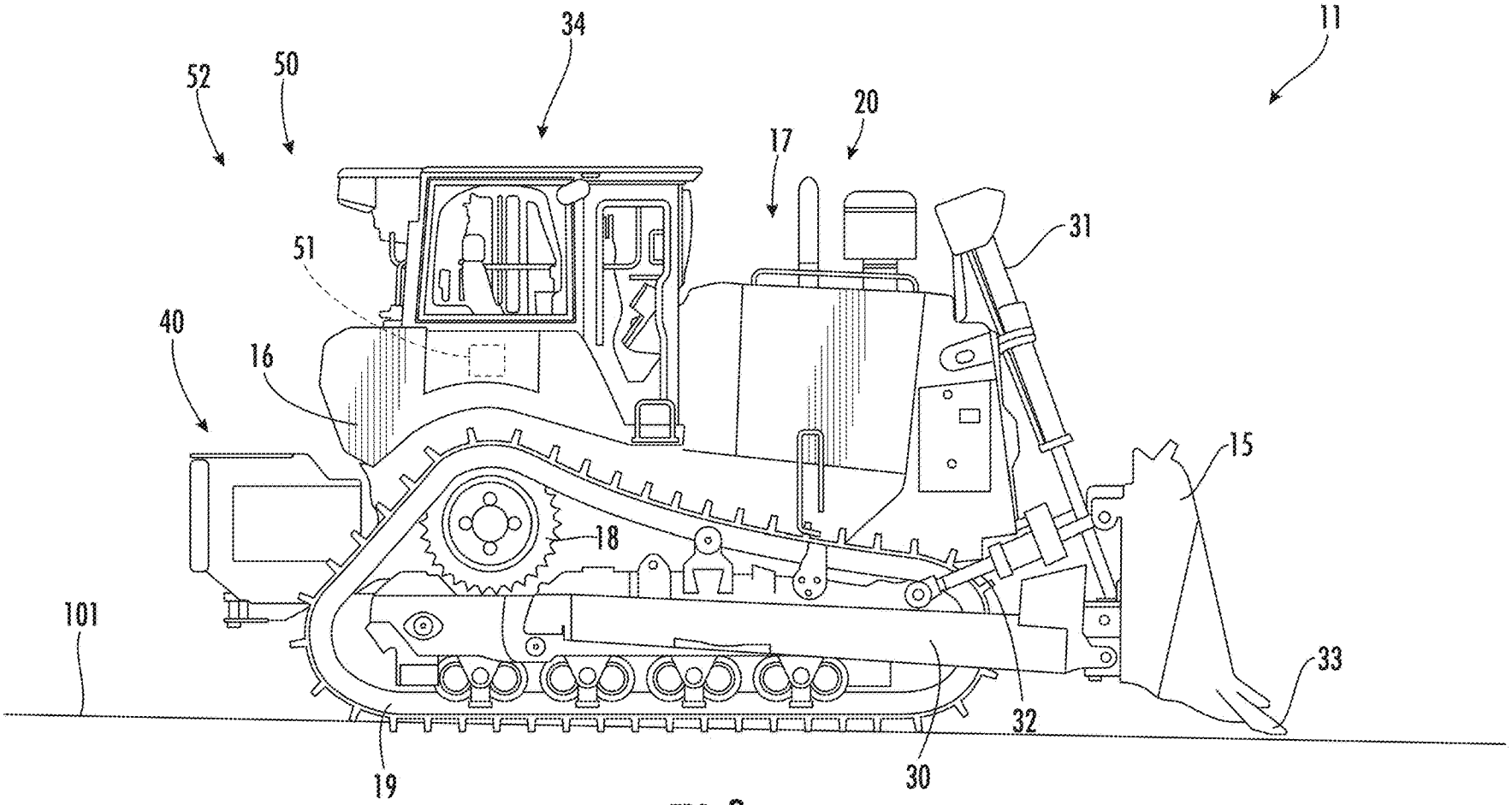
FIG. 2 depicts a diagrammatic illustration of a machine in accordance with the disclosure.

FIG. 2 depicts a diagrammatic illustration of a machine 10 such as a dozer 11 with a ground-engaging work implement such as a blade 15 configured to push material. The dozer 11 includes a frame 16 and a prime mover such as an engine 17. A ground-engaging drive mechanism such as a track 19 may be operatively coupled to the prime mover, through a drive sprocket 18 on opposite sides of the dozer 11, to propel the machine.

Figure 3:
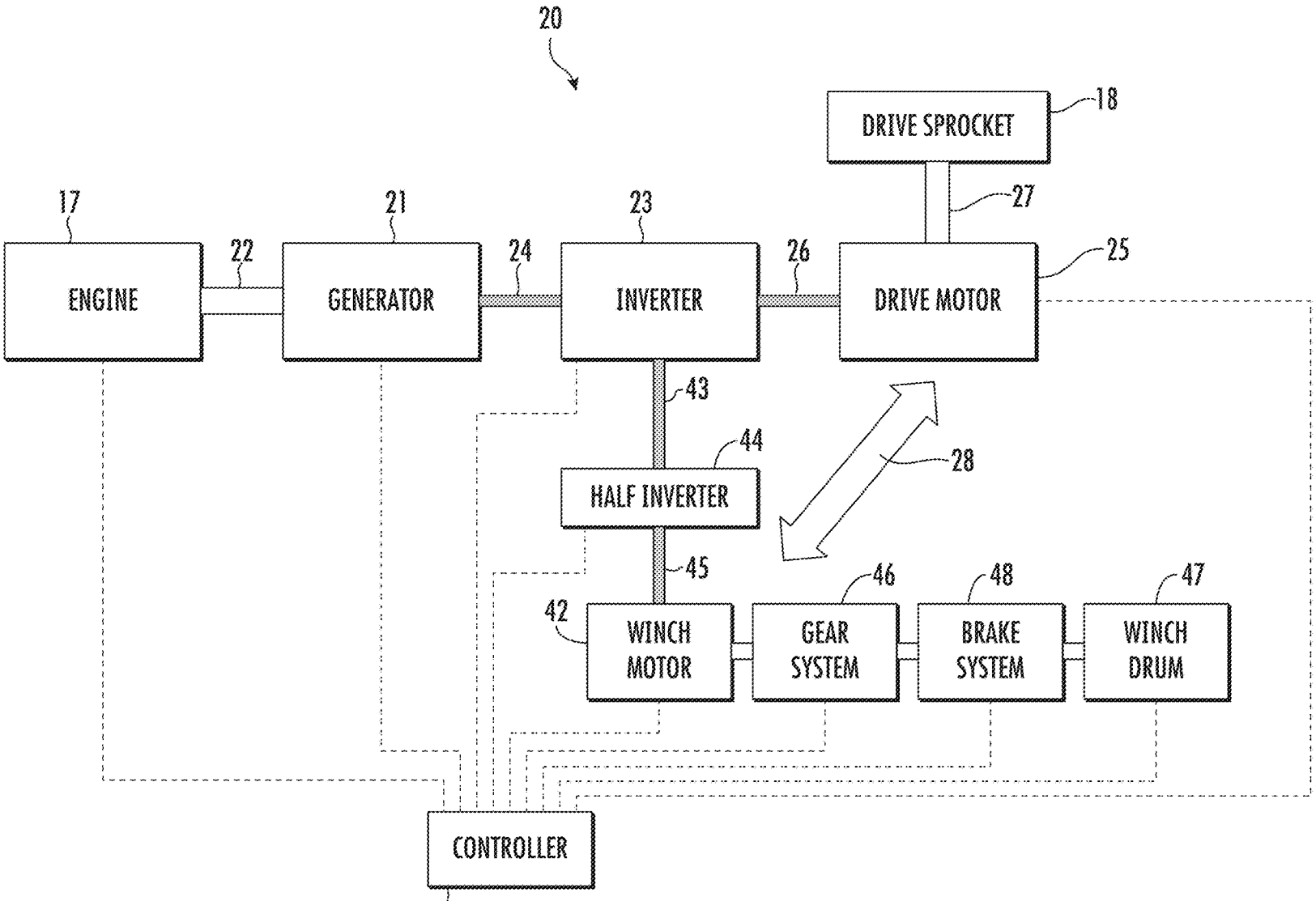
FIG. 3 depicts a block diagram of a portion of an engine, a drivetrain, and a winch assembly of the machine of FIG. 2.

The dozer 11 may include an electric drivetrain 20 operatively connected to the engine 17 to drive the drive sprockets 18 and the tracks 19. Referring to FIG. 3, the electric drivetrain 20 may include a generator 21 operatively connected to the engine 17 by drive shaft 22. The generator 21 converts the rotational power of the engine 17 into electrical power such as AC current. An inverter 23 is electrically connected to the generator 21 through cable assembly 24 and a drive motor 25 is electrically connected to the inverter 23 through cable assembly 26. The drive motor 25 is operatively connected to the drive sprockets 18 through shaft 27 to propel the dozer 11. The inverter 23 is configured to convert the AC power from the generator 21 into DC power. A control strategy may be applied to the DC power by a control system 50 and then a desired amount of DC power converted back to AC power to operate the drive motor 25 as desired. In embodiments, the drive motor 25 may be a switched reluctance motor. Although depicted with a single drive motor 25, a plurality of drive motors may be provided such as by providing a drive motor for each drive sprocket 18. Other configurations of the electric drivetrain 20 are contemplated.

The systems and methods of the disclosure may be used with other machine propulsion and drivetrain mechanisms applicable in the art for causing movement of the dozer 11 including hydrostatic or mechanical drives. Further, although dozer 11 is shown in a "track-type" configuration, other configurations, such as a wheeled configuration, may be used.

Referring back to FIG. 2, the blade 15 may be pivotally connected to frame 16 by arms 30 on each side of the dozer 11. First hydraulic cylinder 31 coupled to frame 16 supports blade 15 in the vertical direction and allows the blade to move up or down vertically from the point of view of FIG. 2. A second hydraulic cylinder 32 on each side of the dozer 11 allows the pitch angle of blade tip 33 to change relative to a centerline of the machine.

Dozer 11 may include a cab 34 that an operator may physically occupy and provide input to control the machine. Cab 34 may include one or more input devices such as a joystick 35 (FIG. 5) through which the operator may issue operating commands to control the propulsion system and steering system of the machine as well as operate various implements associated with the machine.

The dozer 11 may include a winch assembly 40 that operates to reel in and reel out the winch cable 41. The winch assembly 40 may include an electric winch motor 42 (FIG. 3) that is electrically connected to the inverter 23. The winch motor 42 may have any desired configuration. In embodiments, the winch motor 42 may be a switched reluctance motor that operates with AC power. In operation, DC power may be supplied by the inverter 23 through a cable assembly 43 to a second or "half" inverter 44 that converts the DC power to AC power. The AC power is then supplied through cable assembly 45 to drive the winch motor 42. In other embodiments, the inverter 23 may be configured to supply AC power to the winch motor 42 without the half inverter 44. In still other embodiments, the winch motor 42 may be a DC motor and DC power may be supplied by the inverter 23 or through another source on the dozer 11 without the half inverter 44.

A rotatable winch drum 47 may be operatively connected to the winch motor 42 by a gear system 46 that is operatively connected to the motor. In embodiments, the gear system 46 may be configured to provide a plurality of rotations of the winch motor 42 for each rotation of the winch drum 47. Rotation of the winch drum 47 may be prevented by a brake system 48 operatively connected thereto. The gear system 46 and the brake system 48 may have any desired configuration. In embodiments, the gear system 46 and the brake system 48 may be configured with a default condition in which rotation of the winch drum 47 is prevented (i.e., the brake applied) unless the brake system is disengaged. The winch drum 47 may be configured with the winch cable 41 wrapped around it a plurality of times. The number of times that the winch cable 41 is wrapped around the winch drum 47 may be a function of the size (i.e., the diameter and width of the drum) as well as the length and diameter of the winch cable. Other configurations of the winch assembly 40 are contemplated.

The drive motor 25 and the winch motor 42 may be cooled in any desired manner. In an embodiment, the drive motor 25 and the winch motor 42 may utilize a common cooling system 28 in which oil passes through each motor and the cooling system. Other types of cooling systems are contemplated. In other embodiments, each of the drive motor 25 and the winch motor 42 may have its own cooling system.

The operation of the engine 13, electric drivetrain 20, winch assembly 40, and other systems and components of the dozer 11 may be controlled by a control system 50 as shown generally by an arrow in FIG. 2 indicating association with the machine. The control system 50 may include an electronic control module or controller 51 and a plurality of sensors. The controller 51 may receive input signals from an operator operating the dozer 11 from within the cab 24 or off-board the machine through a wireless communications system. The controller 51 may control the operation of various aspects of the dozer 11 including the electric drivetrain 20, hydraulic systems, and the winch assembly 40.

The controller 51 may be an electronic controller that operates in a logical fashion to perform operations, execute control algorithms, store and retrieve data and other desired operations. The controller 51 may include or access memory, secondary storage devices, processors, and any other components for running an application. The memory and secondary storage devices may be in the form of read-only memory (ROM) or random access memory (RAM) or integrated circuitry that is accessible by the controller. Various other circuits may be associated with the controller 51 such as power supply circuitry, signal conditioning circuitry, driver circuitry, and other types of circuitry.

The controller 51 may be a single controller or may include more than one controller disposed to control various functions and/or features of the dozer 11. The term "controller" is meant to be used in its broadest sense to include one or more controllers and/or microprocessors that may be associated with the dozer 11 and that may cooperate in controlling various functions and operations of the machine. The functionality of the controller 51 may be implemented in hardware and/or software without regard to the functionality. The controller 51 may rely on one or more data maps relating to the operating conditions and the operating environment of the dozer 11 and the work site 100 that may be stored in the memory of controller. Each of these data maps may include a collection of data in the form of tables, graphs, and/or equations.

The control system 50 and the controller 51 may be located on the dozer 11 and may also include components located remotely from the machine. The functionality of control system 50 may be distributed so that certain functions are performed at dozer 11 and other functions are performed remotely.

Figure 4:
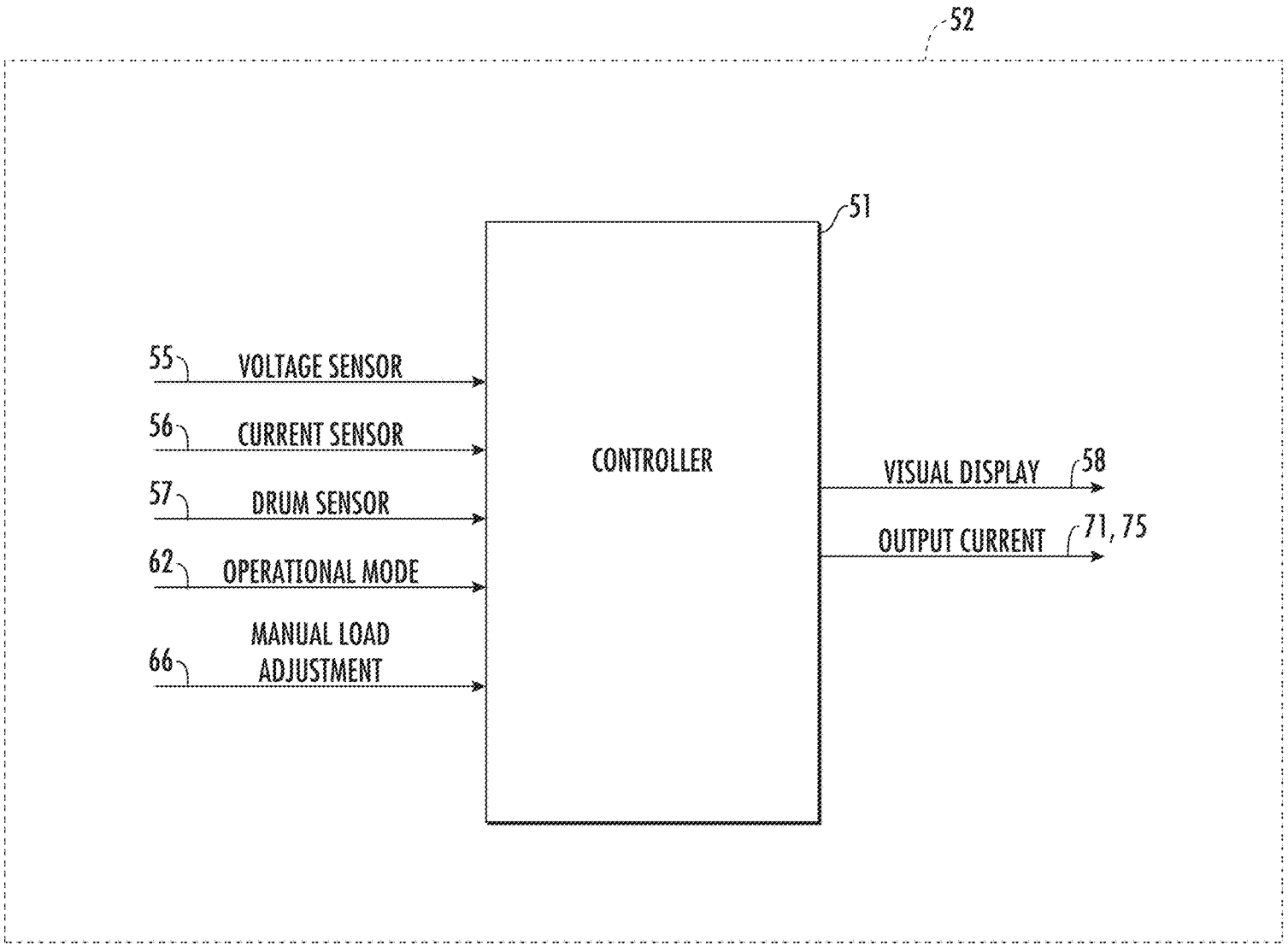
FIG. 4 depicts a block diagram of a portion of the control system of the machine of FIG. 2.

Referring to FIG. 4, dozer 11 may be equipped with a plurality of machine sensors that provide data indicative (directly or indirectly) of various operating parameters of the machine, or operating characteristics of certain components such as the winch motor 42, and/or the operating environment in which the machine is operating. The term "sensor" is meant to be used in its broadest sense to include one or more sensors and related components that may be associated with the dozer 11 and that may cooperate to sense various functions, operations, and operating characteristics of the machine and/or aspects of the environment in which the machine is operating.

A voltage sensor 55 may be provided to sense the voltage at the winch motor 42 and provide voltage data indicative of the voltage. In an embodiment, the voltage sensor 55 may be part of or within the half inverter 44 and have any desired configuration. If the winch assembly 40 does not include the half inverter 44, the voltage sensor 55 may be part of or within the inverter 23. Other locations for the voltage sensor and other configurations of voltage sensors are contemplated.

A current sensor 56 may be provided to sense the current provided to the winch motor 42 and provide current data indicative of the current. In an embodiment, the current sensor 56 may be part of or within the half inverter 44 and have any desired configuration. If the winch assembly 40 does not include the half inverter 44, the current sensor may be part of or within the inverter 23. Other locations for the current sensor and other configurations of current sensors are contemplated.

Inasmuch as the torque provided by the winch motor 42 is a function of the voltage at which the motor is operating and the current provided to the motor, the voltage sensor 55 and the current sensor 56 may define a torque sensor. Accordingly, if the torque provided by the winch motor 42 in a different manner, the necessary current may be determined based upon the torque and the voltage.

A rotation sensor 57 may be provided for sensing, directly or indirectly, the rotational position of the winch drum 47 and for providing rotation data indicative of the rotational position. The rotation sensor 57 may have any desired configuration such as a rotary encoder mounted on or adjacent either the winch motor 42 or the winch drum 47. In some instances, it may be desirable to monitor the position of the winch motor 42 rather than the winch drum 47 since the winch assembly 40 may be configured such that the winch motor rotates a plurality of times for each rotation of the winch drum. The controller 52 may monitor and store rotational data of the winch motor 42 (or winch drum 47) to determine the angular position and the number of rotations of the winch drum 47. In an embodiment, a reference position of zero may correspond to the winch cable 41 being fully retracted.

In addition to operating as a rotation position sensor, the rotation sensor 57 may also be configured to operate as a rotation identification system that senses whether the winch motor 42, and thus the winch drum 47, is rotating or is stationary. In other embodiments, a separate rotation identification sensor may be provided to determine whether the winch motor 42 and/or the winch drum 47 are rotating.

Each of the voltage sensor 55 and the current sensor 56 may be characterized as motor operating characteristic sensors as they generate operating characteristic data or signals indicative of an operating characteristic of the winch motor 42. The voltage sensor 55, the current sensor 56, and the rotation sensor 57 may be characterized as winch operating characteristic sensors as they generate operating characteristic data or signals indicative of an operating characteristic of the winch assembly 40.

The control system 50 may include a winch control system 52 shown generally by an arrow in FIG. 2 indicating association with the machine 10. The winch control system 52 may operate to control the operation of the winch assembly 40. The winch assembly 40 may be configured to operate in a plurality of different operating modes. In a first operating mode, often referred to as a "free spool" mode, the winch drum 47 is disconnected from the remainder of the winch assembly 40 such as by releasing the brake system 48 or a portion of the brake system, and also the gear system 46 or a portion of the gear system. By disconnecting the winch drum 47 from the remainder of the winch assembly 40, the winch drum may be turned, such as to pull or reel out a length of winch cable 41, with very little force, such as approximately 50-100 pounds. In an embodiment, the winch control system 52 may be placed in the free spool mode by pulling the joystick 35 backwards or towards the operator in the cab 34.

In a second operating mode, often referred to as "brake-off" mode, the winch drum 47 remains connected to the gear system 46 but the gear system is not connected to the winch motor 42. As a result, the winch drum 47 is still capable of turning but such turning is resisted by the internal resistance of the gear system. In an example, the force required to pull out a length of winch cable 41 when operating in brake-off mode may be approximately 1,000-2000 pounds. In an embodiment, the winch control system 52 may be placed in the brake-off mode by pushing the joystick 35 forwards or away from the operator.

A third operating mode may be referred to as a "brake-on" mode in which the brake system 48 is engaged so that rotation of the winch drum 47 is prevented and the winch cable 41 remains stationary relative to the winch drum. In an embodiment, the winch control system 52 may be placed in the brake-on mode by allowing the joystick 35 to return to or maintaining the joystick in its centered or default position, or by giving a "reel-in" or "reel-out" command as described below.

A fourth operating mode may be referred to as a "reel-out" mode in which the winch motor 42 is rotated to feed or reel out the winch cable 41. A fifth operating mode may be referred to as a "reel-in" mode in which the winch motor 42 is rotated to reel in the winch cable 41. In an embodiment, the winch control system 52 may be placed in the reel-in mode by pulling the joystick 35 inward laterally and may be placed in the reel-out mode by pushing the joystick 35 outward laterally. The rate at which the winch cable 41 is reeled out or reeled in may be proportional to the amount of displacement of the joystick 35.

In a sixth operating mode, referred to as an "auto-tension" mode, the winch control system 52 may operate to generate a constant load on the winch cable 41. To do so, a desired winch load may be entered into, set within or accessed by the winch control system 52 in any desired manner. In one example, an operator may specify a desired winch load numerically (e.g., 50,000 lbs) through an input device. In another example, an operator may specify a desired winch load based upon a relative scale (e.g., 1-100) with respect to the overall capacity of the winch assembly 40.

Based upon the desired winch load, the winch control system 52 may determine the torque necessary to generate and maintain such a load. Through the use of look-up or data tables stored within the controller 51, the winch control system 52 may determine the current required to generate the desired torque based upon the voltage at the winch motor 42, the geometry of the winch drum 47, and the location of the winch cable 41 relative to the winch drum. In other words, to supply the desired force on the winch cable 41, the winch motor 42 must generate a desired torque in view of the size of the winch drum 47 and the distance of the winch cable 41 from the center of rotation of the drum. The distance of the winch cable 41 from the center of rotation of the winch drum 47 may be determined based upon the known characteristics of the winch drum and the angular or rotational position of the winch drum as determined from rotational signals or data supplied by the rotation sensor 57. Based upon the known voltage at the winch motor 42 as determined from the voltage signals from the voltage sensor, the winch control system 52 may determine the current necessary to generate the required torque.

After a desired winch load has been set within the winch control system 52 when using the auto-tension mode, an operator may further or subsequently adjust the desired winch load or tension on the winch cable 41. This may be desirable in instances in which the desired winch load is set generally and then is more finely adjusted and/or in instances in which operating conditions change.

Figure 5:
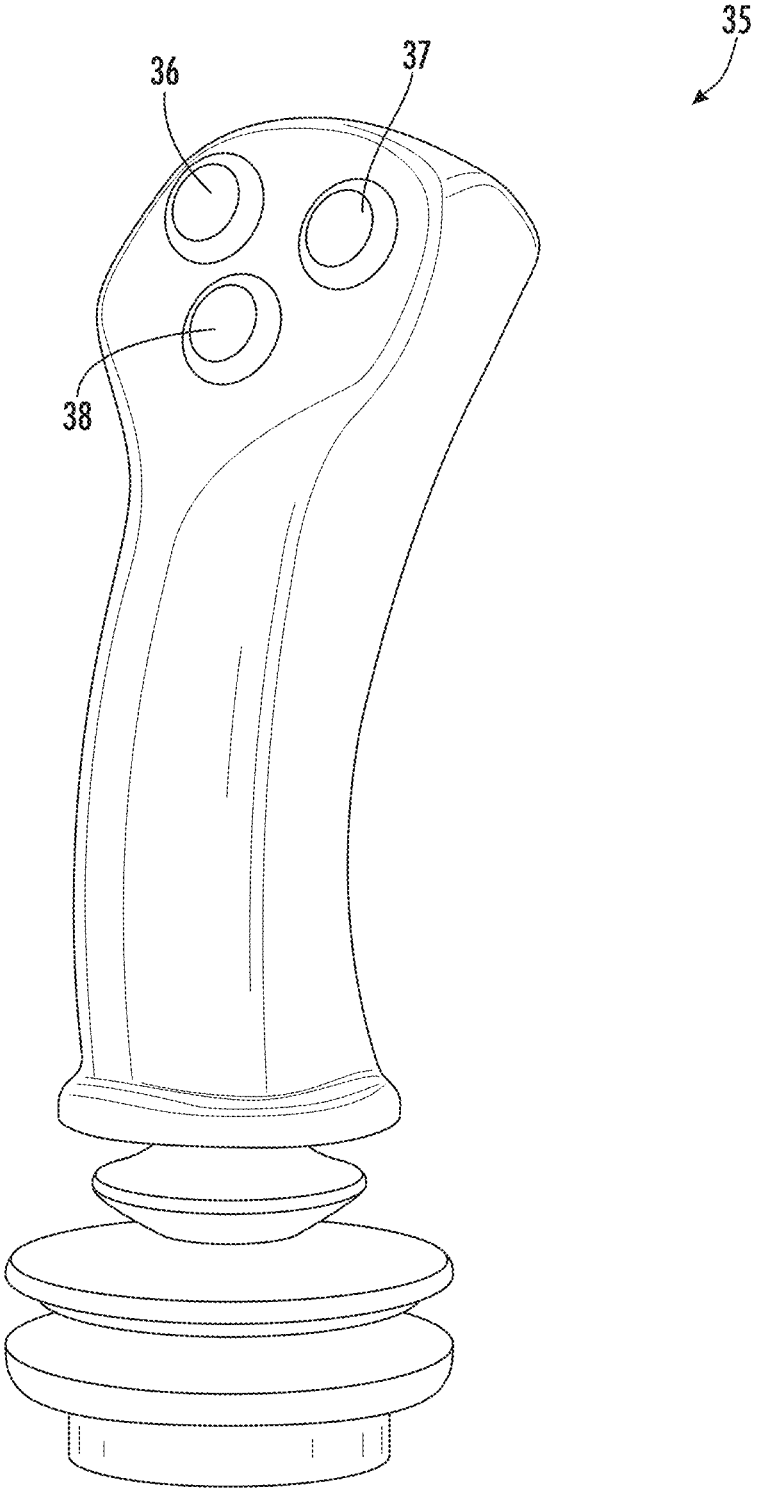
FIG. 5 depicts a diagrammatic illustration of a joystick in accordance with the disclosure.

As an example, an operator may generally set an initial desired winch load (either numerically or on a relative scale), and then increase or decrease the load through an input device. Referring to FIG. 5, the joystick 35 may include three input buttons 36-38. The first input button 36 may operate to enable or turn on and off the auto-tension mode. The second input button 37 may operate to increase the desired winch load and the third input button 38 may operate to decrease the desired winch load. In other embodiments, the second and third input buttons 36, 37 may be replaced by a rotational input device (not shown).

As the dozer 11 and a machine 10 such as the excavator 12 tethered to the winch cable 41 operate, changes in the tension on the cable may occur. Increases in tension on the winch cable 41 will overcome the desired winch load or tension provided by the winch motor 42 and a length of winch cable will be pulled or reeled out of the winch assembly 40. Decreases in tension on the winch cable 41 will cause the desired winch load or tension generated by the winch motor 42 to overcome the tension in the winch cable and cause a length of winch cable to be retracted or reeled into the winch assembly 40.

Other modes of operation are contemplated as are other manners of moving the joystick 35 to initiate, operate, or terminate each operating mode. Further, all winch assemblies may not include or be configured with all of the operating modes described above.

Figure 6:
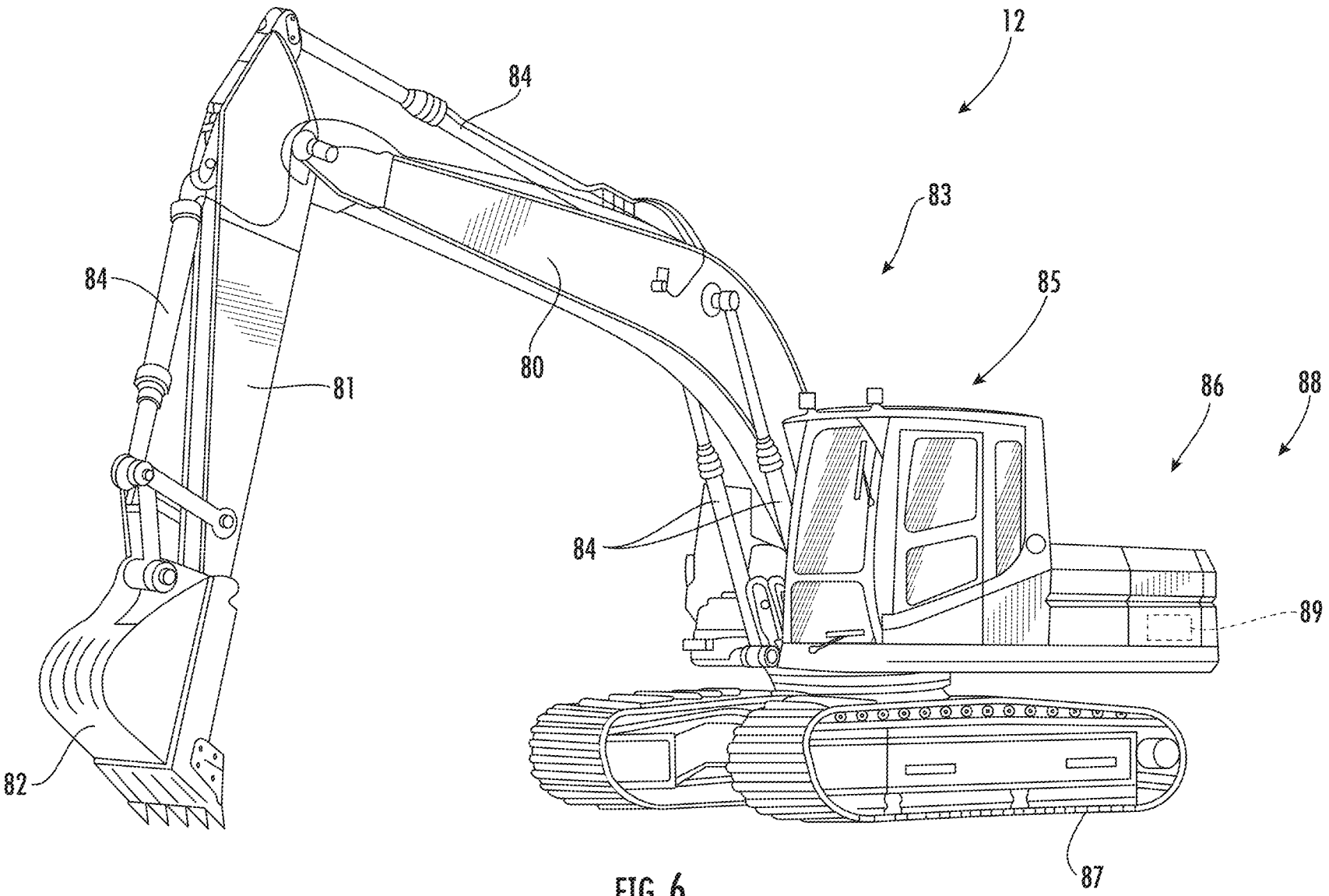
FIG. 6 depicts a diagrammatic illustration of a second machine in accordance with the disclosure.

Referring to FIG. 6, an exemplary machine 10 that may be tethered to a dozer 11 is depicted. The excavator 12 may include an implement system having a boom member 80, a stick member 81, and a work implement 82. The work implement 82 may take any desired form including a bucket, a hydraulic hammer, or a grapple. The implement system may be operatively connected to a hydraulic system generally indicated at 83 including hydraulic cylinders or actuators 84 for causing movement of the implement system. An operator may operate the excavator 12 from an operator station or cab 85. A prime mover 86 is operatively connected to and drives a ground engaging drive mechanism such as tracks 87. The excavator 12 may include a control system 88 and a controller 89 identical or similar to the control system 50 and controller 51 described above and the descriptions thereof are not repeated.

Although depicted with the winch cable 41 extending between a dozer 11 and an excavator 12, the winch assembly 40 may be mounted on any type of machine and may be used for any type of winching operation. For example, the winch assembly 40 may be used to transport any type of equipment such as a pipelayer, a welding rig, or a personnel transport up and down a slope at a work site 100.

INDUSTRIAL APPLICABILITY

The industrial applicability of the winch assembly 40 described herein will be readily appreciated from the forgoing discussion. The foregoing discussion is applicable to systems that use a winch assembly 40 in which it is desirable to perform various winching operations including using the winch motor 42 to maintain a desired winch load on the winch cable 41 without applying or engaging the brake system 48 of the winch assembly. Such winch assembly 40 may be used at a mining site, a landfill, a quarry, a construction site, a roadwork site, a forest, a farm, or any other area in which the use of winch assemblies is desired.

The winch control system 52 may be used to control the operation of the winch assembly 40 such as by controlling the operating modes identified above. In some instances, it may be desirable to use the auto-tension mode rather than using a combination of brake-on, brake-off, and other operating modes. For example, referring back to FIG. 1, three dozers 11 are interconnected by winch cables 41 and support an excavator 12 that is operating on a steeply sloped work surface 101. In such a configuration, the upper two dozers 11 (i.e., farthest to the left in FIG. 1) may typically operate as "anchors" to support the lower dozer 11 (i.e., closest to the excavator 12) and the excavator. As anchors, the upper two dozers 11 may be parked with their service brakes on and with their winch assemblies in a brake-on mode.

In order to simplify or improve the operation of the excavator 12, the winch assembly 40 of the lower dozer 11 may be operated in the auto-tension mode with the desired winch load set at a level that is sufficient to support the excavator 12. The desired winch load may depend upon the size of the excavator 12 as well as the operating conditions and slope of the work surface 101. In one example, the upper limit of the desired winch load may be set at 20,000 pounds while the lower limit may be set at 2,000 pounds. In another example, the upper desired winch load may be set at 50,000 pounds and the lower limit set at 1,000 pounds. Other desired winch loads or limits may be set as desired. Further, in some embodiments, only an upper or lower limit may be set.

The tension on the winch cable 41*a* extending between the lower dozer 11 and the excavator 12 operates to provide support to the excavator while allowing it to perform desired operations without limiting its ability to move along the work surface 101. By using the auto-tension mode, an operator of the excavator 12 may readily perform normal or typical operations along the sloped work surface 101.

Figure 7:
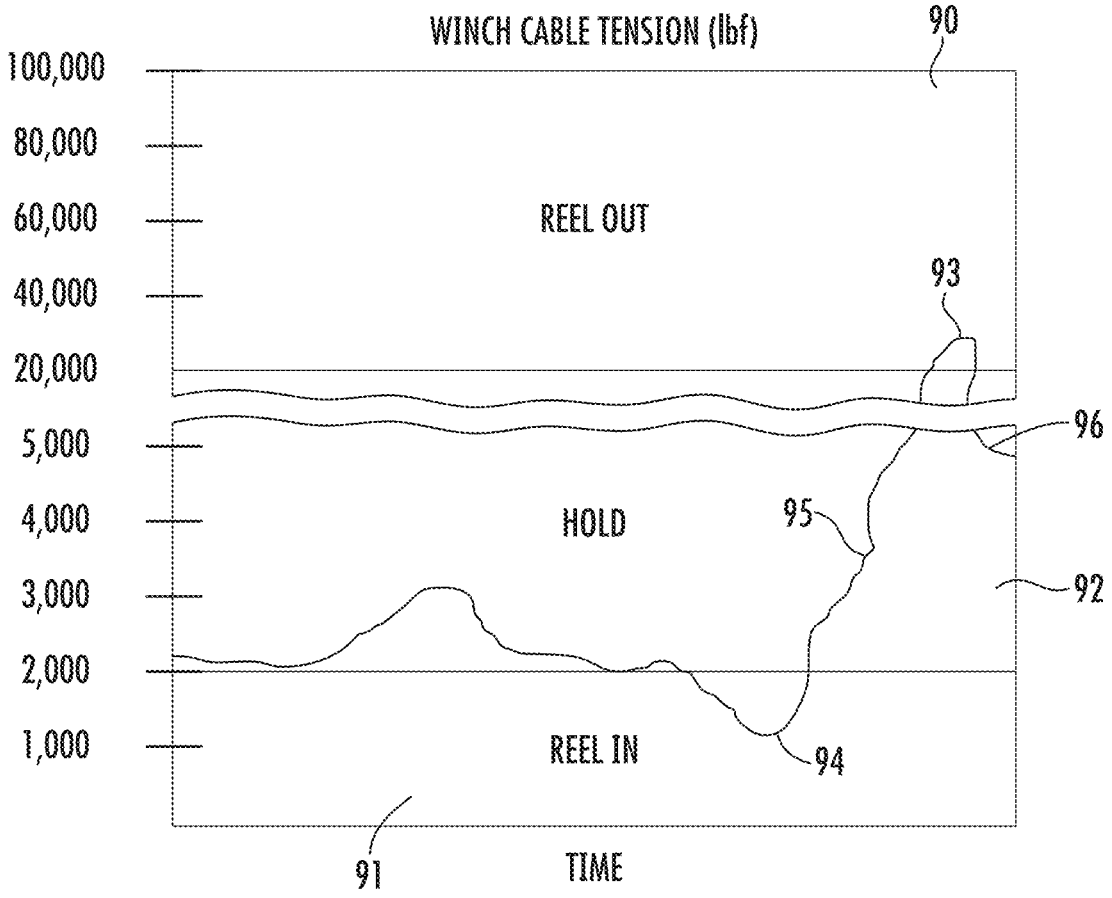
FIG. 7 depicts an exemplary graph of cable load as a function of time.

Referring to FIG. 7, an exemplary graph is depicted in which the load on the winch cable 41 is depicted as function of time. An upper limit of the desired winch load is set at 20,000 pounds and a lower limit is set at 2,000 pounds. Such a configuration defines an upper reel zone 90, a lower reel zone 91, and a hold zone 92. In the depicted example, if the tension on the winch cable 41 is greater than 20,000 pounds, the winch cable will reel or feed out due to the force or load on the winch cable exceeding the force generated by the winch assembly 40. If the tension on the winch cable 41 is less than 2,000 pounds, the winch cable will reel in due to the force or load generated by the winch assembly 40 being greater than that on the winch cable. However, if the tension on the winch cable 41 is between 2,000 and 20,000 pounds, the winch cable will not be reeled out or reeled in as result in changes in the force generated by the winch motor 42.

More specifically, in some instances, the dozer 11 and/or excavator 12 may be driven or propelled down the sloped work surface 101 or laterally (or in some instances upward) and/or operated in such a manner that increases the load or tension on the winch cable 41 so that it exceeds the upper load limit (e.g., 20,000 pounds). In such case, the winch cable tension, indicated at 93 in FIG. 7, has increased and is in the upper reel zone 90. In an embodiment, the increase in tension caused by the propulsion and/or operation of the dozer 11 and/or excavator 12 will create a tension or force imbalance in which the force provided by gravity and the propulsion and/or operation of the excavator will be greater than the opposite force provided by the winch assembly 40 (i.e., the upper load limit). The force imbalance will cause the winch drum 47 to rotate so that the relative movement between the dozer 11 and the excavator 12 will pull out a length of the winch cable 41. That is, the winch control system 52 will continue to supply the same amount of current to the winch motor 42 that will result in generating the desired torque that will in turn result in applying winch load to the winch cable 41 corresponding to the upper load limit. However, the increase in tension due to the propulsion and/or operation of the dozer and/or excavator 12 will cause a length of the winch cable 41 to be pulled out of the winch assembly 40.

By providing a constant or fixed amount of current to the winch motor 42, the force resisting the reeling out of the winch cable 41 will be constant. In some instances, it may be desirable to control the rate at which the winch cable 41 is reeled out to reduce rapid acceleration or deceleration of the reeling process. As result, some changes in the amount of current provided while operating in the upper reel zone 90 are contemplated. It is believed that in some instances, the change in current may be relatively small. Further, in some instances, the changes in current may depend on the characteristics of the dozer 11, the winch assembly 40, and the operating conditions at the work site 100 including the machine or equipment operatively connected to the winch cable 41.

Similarly, the excavator 12 may be driven or propelled up the sloped work surface 101 or laterally (or in some instances downward) and/or operated in such a manner that decreases the load or tension on the winch cable 41 so that it is less than the lower load limit (e.g., 2,000 pounds). In such case, the winch cable tension, indicated at 94 in FIG. 7, has decreased and is in the lower reel zone 91. In an embodiment, the decrease in tension caused by the propulsion and/or operation of the dozer 11 and/or excavator 12 will create a tension or force imbalance in which the force generated by the winch assembly 40 (i.e., the lower load limit) will overcome the load resulting from gravity and the propulsion and/or operation of the dozer 11 and/or excavator 12. The force imbalance will cause the winch motor 42 to rotate and reel in an amount of the winch cable 41 a as result of the force imbalance. That is, the winch control system 52 will continue to supply the same amount of current to the winch motor 42 that will result in generating the desired torque that will in turn result in applying winch load to the winch cable 41*a* corresponding to the lower load limit. However, the decrease in tension due to the propulsion and/or operation of the dozer 11 and/or excavator 12 will cause the winch assembly 40 to reel in a length of the winch cable 41*a*.

By providing a constant or fixed amount of current to the winch motor 42, the force resisting the reeling in of the winch cable 41 will be constant. In some instances, it may be desirable to control the rate at which the winch cable 41 is reeled in to reduce rapid acceleration or deceleration of the reeling process. As result, some changes in the amount of current provided while operating in the lower reel zone 91 are contemplated. It is believed that in some instances, the change in current may be relatively small Further, in some instances, the changes in current may depend on the characteristics of the dozer 11, the winch assembly 40, and the operating conditions at the work site 100 including the machine or equipment operatively connected to the winch cable 41.

In some instances, the excavator 12 may be propelled and/or operated with the load on the winch cable 41 being within the hold zone 92. In other words, the load or tension on the winch cable 41 is greater than the lower load limit (e.g., 2,000 pounds) and less than the upper load limits (e.g., 20,000 pounds). While the winch assembly 40 is operating within the hold zone, winch motor 42 is generating sufficient torque so that the winch drum 47 is not rotating and thus the winch cable is neither being reeled in nor reeled out. To do so, the controller 51 generates a sufficient amount of current so that the load generated by the winch assembly 40 matches the load on the winch cable 41 resulting from gravity as well as the propulsion and/or operation of the dozer 11 and/or the excavator 12 or other equipment attached to the cable.

More specifically, referring to FIG. 7, as the tension on the winch cable 41 increases from the lower load limit towards a midpoint depicted at 95 between the lower load limit and the upper load limit, the current generated and supplied to the winch motor 42 increases so that the torque generated by the motor also increases. The increase in torque generated by the winch motor 42 results in an increase in force generated by the winch assembly 40 that is equal to the tension on the winch cable 41 and thus operates to balance counteract the load on the winch cable as a result of movement or operation of the dozer 11 and/or excavator 12.

Further increases in load on the winch cable 41 will similarly result in increases in current provided to the winch motor 42 and thus an increase in torque generated by the motor and force generated by the winch assembly 40 to match the increase in load on the winch cable. Similarly, a decrease in load on the winch cable 41 such as at 96 will result in a decrease in current provided to the winch motor 42 and thus a decrease in torque generated by the motor and force generated by the winch assembly 40. In each instance, while operating within the hold zone 92, the load generated by the winch assembly matches the tension on the winch cable 41 to prevent the cable from being reeled in or reeled out.

In order to prevent rotation of the winch assembly 40 while operating within the hold zone 92, the rotation sensor 57 may be monitored by the controller 51 to determine whether the winch motor 42 is beginning to rotate. If the winch motor 42 begins to rotate, the generated current may be increased or decreased, depending upon the direction of rotation of the winch motor, to resist or offset the motor rotation. For example, if the winch motor 42 begins to rotate to reel out the winch cable 41 while operating in the hold zone 92, the current is increased until the winch motor 42 no longer is rotating. In other words, the current is increased so that the torque is increased and this process continues until the resulting force on the winch cable 41 as a result of the winch assembly 40 is equal to the load on the cable as a result of the excavator or other equipment attached thereto. Similarly, if the winch motor 42 begins to rotate to reel in the winch cable while operating in the hold zone, the current is decreased until the winch motor is no longer rotating.

The current supplied to the winch motor 42 while operating in the upper reel zone 90 is sometimes referred to herein as the reel current or the upper reel current. The current supplied to the winch motor 42 while operating in the lower reel zone 91 is sometimes referred to herein as the reel current or the lower reel current. The current supplied to the winch motor 42 while operating in the hold zone 92 is sometimes referred to herein as the hold current.

Although described in the context of the monitoring the rotation of the winch motor 42, the rotation of the winch drum 47 may be monitored in addition or alternatively.

It should be noted that as the winch cable 41 is fed out of the winch drum 47, the distance between the winch cable and the center of rotation of the winch drum may change. The change in distance between the winch cable 41 and the center of rotation of the winch drum 47 may be determined based upon data from the rotation sensor 57. The winch control system 52 may adjust the input current to the winch motor 42 to compensate for changes in the distance to the center of rotation of the winch drum 47.

In some embodiments, it may be possible to improve the winch operation by using the auto-tension mode in place of some of the other operating modes described above. In addition or in the alternative, using the auto-tension mode in place of some of the other operating modes may permit cost reductions or improvements in the design or operation of the winch assembly 40. For example, as stated above, when operating in the brake-off mode, the winch drum 47 may be rotated upon the application of a load of approximately 1,000-2,000 pounds. This load is required when some or all of the clutches within the gear system 46 are not released so that the gear system remains connected to the winch drum 47. If desired, the winch control system 52 may be configured to provide a mode that imitates or approximates the brake-off mode by requiring a load on the winch cable 41 of approximately 1,000-2000 pounds before the cable may be pulled from the winch drum 47. In other instances, the auto-tension mode or a modification thereof may be used to imitate or approximate other operating modes. Further, a variation of the auto-tension mode may be used when applying or removing the brake to reduce any sudden changes in the load on the winch cable 41.

Although the load on the winch cable 41 may be determined based upon the current provided to the hydraulic winch motor 42, the voltage at the hydraulic winch motor, and the distance of the winch cable 41 from the center of rotation of the winch drum 47, in other embodiments, the load on the winch cable may be determined by a cable load sensor (not shown) on or associated with the winch cable. Such a cable load sensor may take any desired form and may be positioned at any location. In an example, a cable load sensor may be disposed on a portion of the cable or interact with the cable to generate signals indicative of the load on the winch cable 41.

Thus, as used herein, a cable load sensor may take many different forms to directly or indirectly measure the cable tension and generate tension data indicative of the tension on the winch cable. In one embodiment, the cable load sensor may be a sensor on or associated with the winch cable. In another embodiment, the cable load sensor may be a combination of the voltage sensor 55, the current sensor 56, and the rotation sensor 57. In other embodiments, the voltage sensor 55 may be omitted such as when estimating the voltage and/or the rotation sensor 58 may be omitted such as when approximating the position of the winch cable 41 relative to the center of the winch drum 47.

Figure 8:
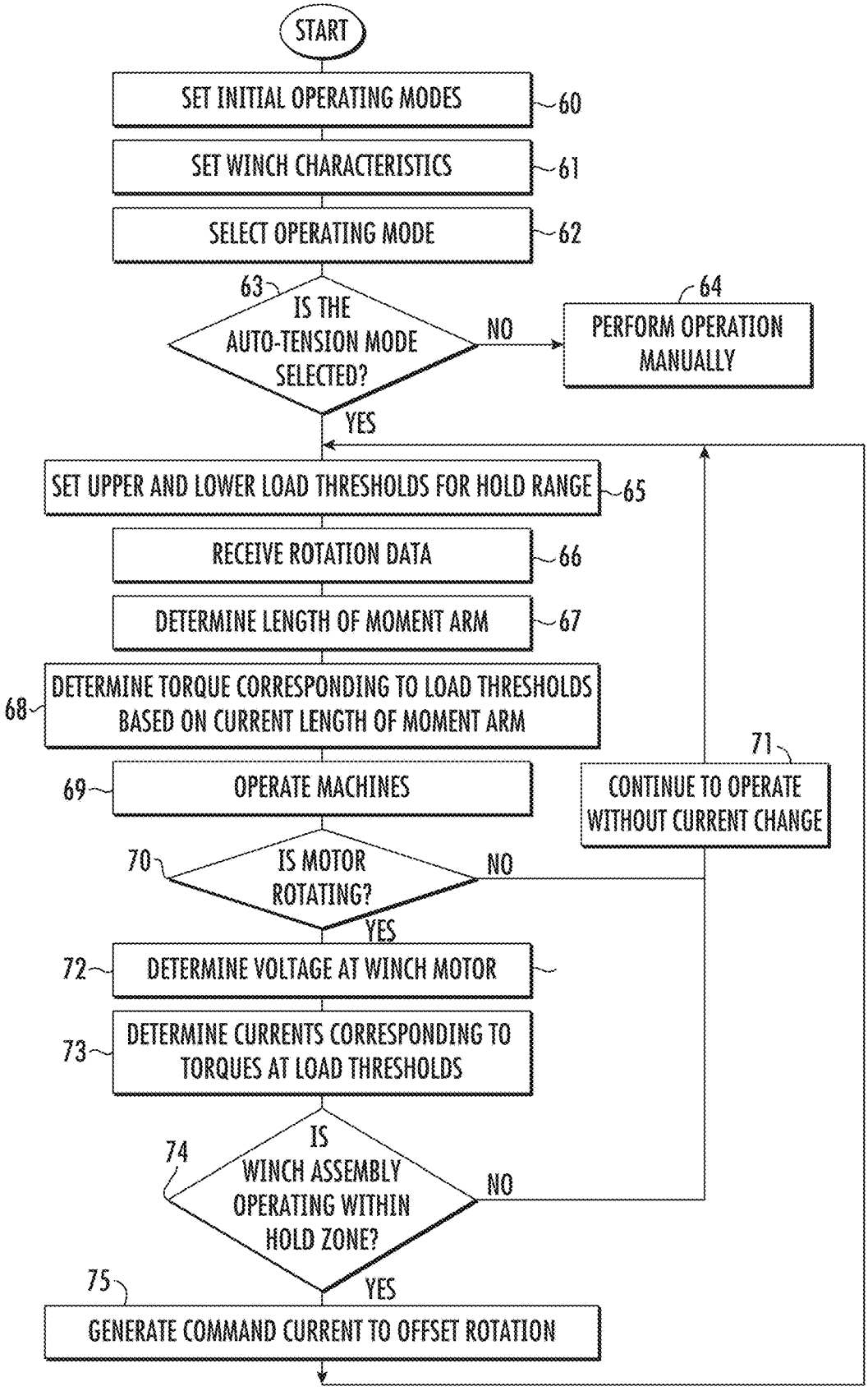
FIG. 8 depicts a flowchart illustrating the operation of the winch assembly in accordance with the disclosure.

The flowchart of FIG. 8 depicts the operation of the winch assembly 40 and includes details of the operation as the winch assembly operates in the auto-tension mode. At stage 60, a plurality of operating modes may be set or stored within the controller 51. The operating modes may correspond to any or all of the modes described above as well as any other desired operating modes. In addition, one or more desired winch loads thresholds or default settings may be set for use when operating in the auto-tension mode. For example, upon enabling the auto-tension mode, the winch control system 52 may be configured to use a default setting for the upper load threshold on the winch cable 41 (e.g., 20,000 pounds, 50,000 pounds, or any other desired value) and/or an default setting for the lower load threshold (e.g., 1,000 pounds, 2,000 pounds, or any other desired value). In some embodiments, a display signal 58 (FIG. 4) may be generated by the controller 51 to display the default setting on a display device within the cab 34, either as an absolute number or as a relative number or scale with respect to the overall capacity of the winch assembly 40.

Winch characteristics may be set or stored within the memory of the controller 51 at stage 61. The winch characteristics may include winch dimensional characteristics of the winch drum 47 such as the dimensions (e.g., diameter and axial width) and/or the distance of the winch cable 41 from the center of rotation of the winch drum for each winch rotational position. The distance of the winch cable 41 from the center of rotation of the winch drum may be set or stored within the controller 51 as a function of the absolute rotational position of the winch drum 47 (i.e., the position of the winch drum together with the number of rotations from the fully retracted position). In other instances, the distance from the center of rotation of the winch drum 47 may be approximated by using the average distance or some other value. In some instances, the actual distance may be used with the torque generated by the winch motor 42 to determine the load or tension on the winch cable 41. In still other instances, the load or tension on the winch cable 41 may be determined based upon the approximate distance of the winch cable 41 from the center of rotation or by using some other value.

Additional winch characteristics may include the torque of the winch motor 42 for each possible voltage and current combination. Still further, the load or tension generated by the winch assembly on the winch cable 41 may be stored or set within the memory of the controller 51 as a function of each combination of winch motor voltage and current as well as each possible rotational position of the winch drum 47. If the distance from the center of rotation of the winch drum is approximated, the load or tension generated by the winch assembly may be stored or set as a function of the center of rotation distance, the voltage, and the current.

At stage 62, an operator may select the desired operating mode. By selecting any of the operating modes other than "brake-on," the brake system will be disengaged. The controller 51 may determine at decision stage 63 whether the operating mode selected by the operator is the auto-tension mode. If the operating mode selected by the operator is not the auto-tension mode, the winch control system 52 may permit manual operation of the winch assembly 40 at stage 64.

If the operating mode selected by the operator at decision stage 63 is the auto-tension mode, the winch control system 52 may begin to operate according to the auto-tension mode process. More specifically, an upper load threshold and/or a lower load threshold may be set or stored within the controller 51 at stage 65. In some embodiments, default thresholds may be set or stored in memory at stage 60. Further, in some embodiments, the upper load threshold and/or lower load threshold may be set or adjusted in other manners. For example, an operator of the dozer 11 may enter the type of machine or object attached to the winch cable 41 either according to its general type or model number or according to a unique identification number associated with that machine or object. In other instances, such information may be automatically sensed by a sensor associated with the winch control system 52. In addition, an operator may change the upper load threshold and/or lower load threshold as desired regardless of whether they were pre-set or stored at stage 60 or whether they were set or stored at stage 65.

At stage 66, the controller 51 may receive rotational data from the rotation sensor 57 and determine the rotational position of the winch drum 47 based upon rotational data provided by the rotation sensor. The controller 51 may determine at stage 67 the distance from the winch cable 41 extending from the winch drum 47 to the center of the winch drum based upon the rotational data. As described above, in some instances the controller 51 may utilize an average or some approximation for the moment arm relative to the winch cable 41 and the winch drum 47.

At stage 68, the controller 51 may determine the torque corresponding to each of the upper load threshold and the lower load threshold based upon the moment arm (the distance from the winch cable 41 extending from the winch drum 47 to the center of the winch drum) of the winch assembly 40.

The dozer 11 and/or excavator 12 may be operated at stage 69. While doing so, the load on the winch cable 41 may change over time such as depicted in the exemplary graph of FIG. 7. At decision stage 70, the controller 51 may determine whether the winch motor 42 (and thus the winch drum 47) is rotating based upon rotational data from the rotation sensor 57. If the winch motor 42 is not rotating, there is no force imbalance between the force generated by the winch assembly 40 and the load or tension on the winch cable 41 and the winch cable will not be reeled out or reeled in. In such case, the amount of current generated and supplied to the winch motor 42 is generating an amount of torque, in view of the length of the moment arm of the winch cable 41 on the winch drum 47, to equal the load on the winch cable. As a result, the controller 51 may continue to generate a current command at stage 71 so that the system operates without a change in current. The machines such as dozer 11 and excavator 12 may then continue to be operated as desired and stages 65-75 repeated.

However, if the winch motor 42 is rotating at decision stage 70, the controller 51 may determine the voltage at the winch motor 42 at stage 72 based upon the voltage data provided by the voltage sensor 55. In other embodiments, the voltage may not be measured and an expected voltage at the winch motor 42 may be used. Further, the voltage may be measured but the expected voltage used unless the measured voltage exceeds a voltage threshold.

The controller 51 may determine at stage 73 the currents corresponding to the load at each of the upper load threshold and the lower load threshold based upon the torque corresponding to each of the thresholds as determined at stage 68, the distance of the winch cable 41 from the center rotation of the winch drum 47 as determined at stage 67, and the voltage at the winch motor 42 as determined at stage 72.

The controller 51 may determine whether the winch assembly 40 is operating within the upper reel zone 90, the lower reel zone 91, or the hold zone 92 at decision stage 74. To do so, the controller 51 may compare the current provided to the winch motor 42 to the currents corresponding to each of the upper load threshold and the lower load threshold.

If the current provided to the winch motor 42 is greater than the current corresponding to the upper load threshold, the winch assembly 40 is operating within the upper reel zone 90. If the current provided to the winch motor 42 is less than the current corresponding to the lower load threshold, the winch assembly 40 is operating within the lower reel zone 91. If the current provided to the winch motor 42 is less than the current corresponding to the upper load threshold and greater than the current corresponding to the lower load threshold, the winch assembly 40 is operating within the hold zone 92. Other manners of determining whether the winch assembly 40 is operating within the hold zone 92 are contemplated.

If the winch assembly 40 is not operating within the hold zone 92 (i.e., the current provided to the winch motor is not within the hold zone), the controller 51 may continue to generate a reel current command at stage 71 so that the system operates without a change in current. In doing so, a constant or fixed amount of reel current will be provided to the winch motor 42 so that the force resisting the reeling out or reeling in of the winch cable 41 will be constant.

More specifically, if the system is operating within the upper reel zone 90, the upper reel current may be fixed at current level corresponding to the upper load threshold and the winch cable 41 reeled out due to the load imbalance between the equipment such as the excavator 12 on one end of the winch cable and the winch assembly 40 on the opposite end. If the system is operating within the lower reel zone 91, the lower reel current may be fixed at current level corresponding to the lower load threshold and the winch cable 41 reeled in due to the load imbalance between the equipment such as the excavator 12 on one end of the winch cable and the winch assembly 40 on the opposite end. As stated above, in some instances, it may be desirable to control the rate at which the winch cable 41 is reeled out or reeled in to reduce rapid acceleration or deceleration of the reeling process. As result, some changes in the amount of current provided while operating in the upper reel zone 90 or lower reel zone 91 are contemplated.

The machines such as dozer 11 and excavator 12 may then continue to be operated as desired and stages 65-75 repeated.

If the winch assembly 40 is operating within the hold zone 92 (i.e., the current provided to the winch motor is within the hold zone), the controller 51 may generate a current command to prevent rotation of the winch assembly 40.

In order to do so, the rotation sensor 57 may be monitored by the controller 51 to determine whether the winch motor 42 is beginning to rotate. If the winch motor 42 begins to rotate, the generated current may be increased or decreased, depending upon the direction of rotation of the winch motor, to resist or offset the motor rotation. For example, if the winch motor 42 begins to rotate to reel out the winch cable 41 while operating in the hold zone 92, a current command is generated to increase the current until the winch motor 42 no longer is rotating. In other words, the current is increased so that the torque is increased and this process continues until the resulting force on the winch cable 41 as a result of the winch assembly 40 is equal to the load on the cable as a result of the excavator or other equipment attached thereto. Similarly, if the winch motor 42 begins to rotate to reel in the winch cable while operating in the hold zone, a current command may be generated to decrease the current until the winch motor is no longer rotating.

The machines such as dozer 11 and excavator 12 may then continue to be operated as desired and stages 65-75 repeated.

It should be noted that at any time during operation in auto-tension mode, an operator may elect to operate the winch assembly 40 in manual mode by generating an appropriate command or moving the joystick 35 in a desired manner.

Further, the example of FIG. 8 may be modified when using a cable load sensor on the winch cable 41 to determine the load on the winch cable.

It will be appreciated that the foregoing description provides examples of the disclosed system and technique. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

The invention claimed is:

1. A system for controlling interconnected operation between a first movable machine and a second movable machine comprising:

a first movable machine including a winch assembly with a winch cable partially wrapped around a rotatable drum operatively coupled to a winch motor;

a second movable machine tethered to the first movable machine by the winch cable partially extending from the winch assembly;

an operator input device configured to receive a desired winch load including an upper load threshold and a lower load threshold that define an upper reel zone, a lower reel zone, and a hold zone there between;

a winch operating characteristic sensor operatively associated with the winch assembly on the first machine and configured to sense a winch operating characteristic;

an electronic controller in electronic communication with the operator input device to receive the desired winch load there from and in electronic communication with the winch operating characteristic sensor to receive a winch operating characteristic signal there from indicative of the winch operating characteristic, the electronic controller configured to operate the winch assembly in an auto-tensioning mode wherein the electronic controller:

(i) determines from the winch operating characteristic whether a winch cable tension associated with the winch cable is in the upper reel zone, the lower reel zone, or the hold zone, (ii) operates the electric winch motor to resist rotation of the rotatable drum while maintaining the desired winch load if the winch cable tension is within the hold zone during the auto-tensioning mode.

2. The system of claim 1, wherein the winch assembly reels out winch cable if the winch cable tension exceeds the upper load threshold and is within the upper reel zone to enable relative movement between the first movable machine and the second movable machine.

3. The system of claim 2, wherein the electronic controller directs application of an upper reel current to the winch motor that is constant and fixed by the upper load threshold to result in a force imbalance on the winch assembly causing the rotatable drum to rotate and reel out the winch cable.

4. The system of claim 1, wherein the winch assembly reels in the winch cable if the winch cable tension is less than the lower load threshold and within the lower reels zone to retract the winch cable between the first moveable machine and the second movable machine.

5. The system of claim 4, wherein the electronic controller applies a lower reel current to the winch motor that is constant and fixed by the lower load threshold to result in a force imbalance on the winch assembly causing the rotatable drum to rotate and reel in the winch cable.

6. The system of claim 1, wherein the electronic controller is further configured to direct application of a hold current when the winch cable tension is within the hold zone, the hold current configured to operate the winch motor to resist rotation of the rotatable drum.

7. The system of claim 6, wherein the hold current directed by the electronic controller is proportional to the winch cable tension on the winch cable while the winch cable tension is within the hold zone.

8. The system of claim 7, wherein the electronic controller is configured to:

increase the hold current if the rotatable drum begins to rotate to reel out the winch cable; and decrease the hold current if the rotatable drum begins to rotate to reel in the winch cable.

9. The system of claim 1, wherein the winch operating characteristic sensor includes one or more of a current sensor sensing current provided to the winch motor, a voltage sensor sensing voltage at the winch motor, and a rotation sensor for sensing rotation of the rotatable drum.

10. The system of claim 9, wherein the winch cable tension is determined from winch operating characteristic signals provided by one or more of the current sensor, the voltage sensor, and the rotation sensor.

11. The system of claim 10, wherein the electronic controller is further configured to access a winch dimensional characteristic of the winch assembly to determine the winch cable tension.

12. The system of claim 1, wherein the electronic controller is configured to operate the winch assembly in a free spool mode that disengages a brake system associated with the winch assembly and allows free relative movement between the first movable machine and the second movable machine that are tethered together.

13. The system of claim 12, wherein the operator input device is a joystick and selection of the auto-tensioning mode and the free spool mode is received through manipulation of the joy stick.

14. A method of operating a plurality of movable machines interconnected together along a slope comprising:

tethering a first movable machine having a winch assembly to a second movable machine with a winch cable extending from the winch assembly, the winch cable partially wound around a rotatable winch of the winch assembly;

setting a desired winch load including an upper load threshold and a lower load threshold, the upper load threshold and the lower load threshold defining an upper reel zone, a lower reel zone, and a hold zone;

sensing a winch operating characteristic with a winch operating characteristic sensor operatively associated with the winch assembly;

determining, via an electronic controller receiving winch operating character signals from the winch operating character sensor that is indicative of the winch operating characteristic, whether a winch cable tension associated with the winch cable is in the upper real zone, the lower reel zone, or the hold zone; and operating the electric winch motor to resist rotation of a rotatable drum while maintaining the desired winch load if the winch cable tension is within the hold zone during an auto-tensioning mode.

15. The method of claim 14, further comprising reeling out the winch cable by rotation of the rotatable drum when the winch cable tension exceeds the upper load threshold and is within the upper reel zone to enable relative movement between the first movable machine and the second movable machine.

16. The method of claim 15, further comprising reeling in the winch cable by rotation of the rotatable drum when the winch cable tension is less than the lower load threshold and is within the lower reel zone to retract the winch cable between the first movable machine and the second movable machine.

17. The method of claim 16, further comprising generating a hold current when the winch cable tension is within the hold zone, the hold current being proportional to the winch cable tension.

18. The method of claim 14, further comprising operating the winch assembly in a free spool mode by disengaging a brake system associated with the winch assembly and allowing free relative motion between the first movable machine and the second movable machine.

19. The method of claim 18, wherein selection of the auto-tensioning mode and the free spool mode is received through manipulation of a joystick operatively associated with the electronic controller.

20. The method of claim 14, further comprising tethering a third movable machine having a second winch assembly to the first movable machine with a second winch cable extending from the second winch assembly, the second winch assembly set in a brake-on mode by engaging a second brake system of the second winch assembly.

* * * * *